US006910997B1

(12) United States Patent
Yampolsky et al.

(10) Patent No.: US 6,910,997 B1
(45) Date of Patent: Jun. 28, 2005

(54) MACHINE AND METHOD FOR MAKING PAPER DUNNAGE

(75) Inventors: Vladimir Yampolsky, San Carlos, CA (US); Charles Daigle, Santa Clara, CA (US)

(73) Assignee: Free-Flow Packaging International, Inc., Redwood City, CA (US)

( * ) Notice: Subject to any disclaimer, the term of this patent is extended or adjusted under 35 U.S.C. 154(b) by 0 days.

(21) Appl. No.: 10/811,020

(22) Filed: Mar. 26, 2004

(51) Int. Cl.[7] ..... B31B 1/00

(52) U.S. Cl. ..... 493/464; 493/350; 493/407; 493/967

(58) Field of Search ..... 493/464, 350, 493/352, 407, 967

(56) References Cited

U.S. PATENT DOCUMENTS

| | | | | |
|---|---|---|---|---|
| 2,786,399 | A * | 3/1957 | Mason et al. | 493/369 |
| 3,799,039 | A * | 3/1974 | Johnson | 493/357 |
| 4,747,816 | A * | 5/1988 | Matsuyama et al. | 493/407 |
| 5,730,696 | A * | 3/1998 | Simmons | 493/478 |
| 5,755,656 | A * | 5/1998 | Beierlorzer | 493/464 |
| 5,938,580 | A * | 8/1999 | Siekmann | 493/38 |
| 6,179,765 | B1 * | 1/2001 | Toth | 493/360 |
| 6,471,154 | B1 | 10/2002 | Toth | |
| 6,503,182 | B2 | 1/2003 | Toth | |
| 2002/0193224 | A1 | 12/2002 | Toth | |
| 2003/0087741 | A1 | 5/2003 | Toth | |

* cited by examiner

*Primary Examiner*—Sameh H. Tawfik
(74) *Attorney, Agent, or Firm*—Edward S. Wright

(57) ABSTRACT

Dunnage making machine and method in which a web of paper is drawn across a forming bar with curved end sections to roll the edge portions of the paper, then drawn through a first throat section to urge the rolled edge portions toward each other and cause them to gather, and thereafter through a second throat section of lesser dimension than the first to gather the central portion of the paper and further gather the edge portions. The gathered paper is then pressed with a roller to crumple it, following which the crumpled paper is perforated along a serrated tear line.

13 Claims, 7 Drawing Sheets

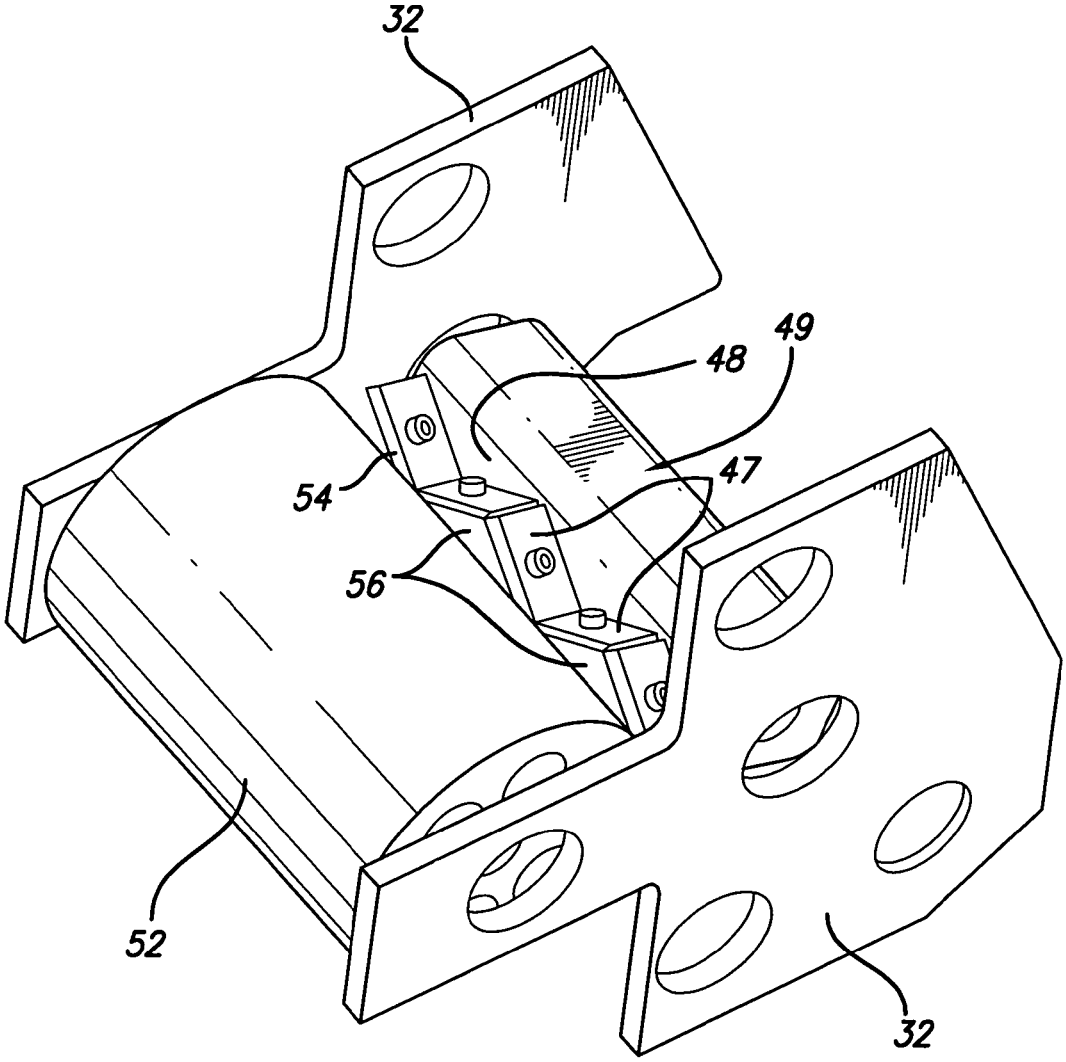
FIG. 5
FIG. 7
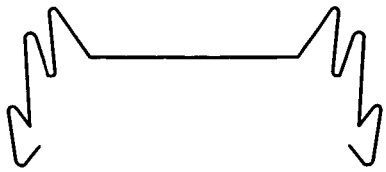

MACHINE AND METHOD FOR MAKING PAPER DUNNAGE

BACKGROUND OF THE INVENTION

1. Field of Invention

This invention pertains generally to packing materials and, more particularly, to a machine and method for making paper dunnage.

2. Related Art

Voids between an item and the carton or container in which it is shipped are commonly filled with a dunnage material to cushion the item and prevent it from shifting about within the carton during shipment. Fill materials include loose fill packing materials, plastic bubble wrap, air-filled bags, expandable foam, and crumpled paper. Bubble wrap and expanded foam are difficult to recycle and create environmental problems if disposed of. Crumpled paper is relatively easy to recycle, but the machines for forming it can be economically infeasible for small businesses or individuals.

OBJECTS AND SUMMARY OF THE INVENTION

It is, in general, an object of the invention to provide a new and improved machine and method for making paper dunnage.

Another object of the invention is to provide a machine and method of the above character which overcome the limitations and disadvantages of dunnage making equipment heretofore provided.

These and other objects are achieved in accordance with the invention by providing a dunnage making machine and method in which a web of paper is drawn across a forming bar with curved end sections to roll the edge portions of the paper, then drawn through a first throat section to urge the rolled edge portions toward each other and cause them to gather, and thereafter through a second throat section of lesser dimension than the first to gather the central portion of the paper and further gather the edge portions. The gathered paper is then pressed with a roller to crumple it, following which the crumpled paper is perforated along a serrated tear line.

BRIEF DESCRIPTION OF THE DRAWINGS

FIG. 5 is an isometric view of the crumpling mechanism with some of the parts removed in order to better illustrate the perforating knives.

FIG. 7 is a cross-sectional view taken along line 7—7 in FIG. 6.

DETAILED DESCRIPTION

Figure 1:
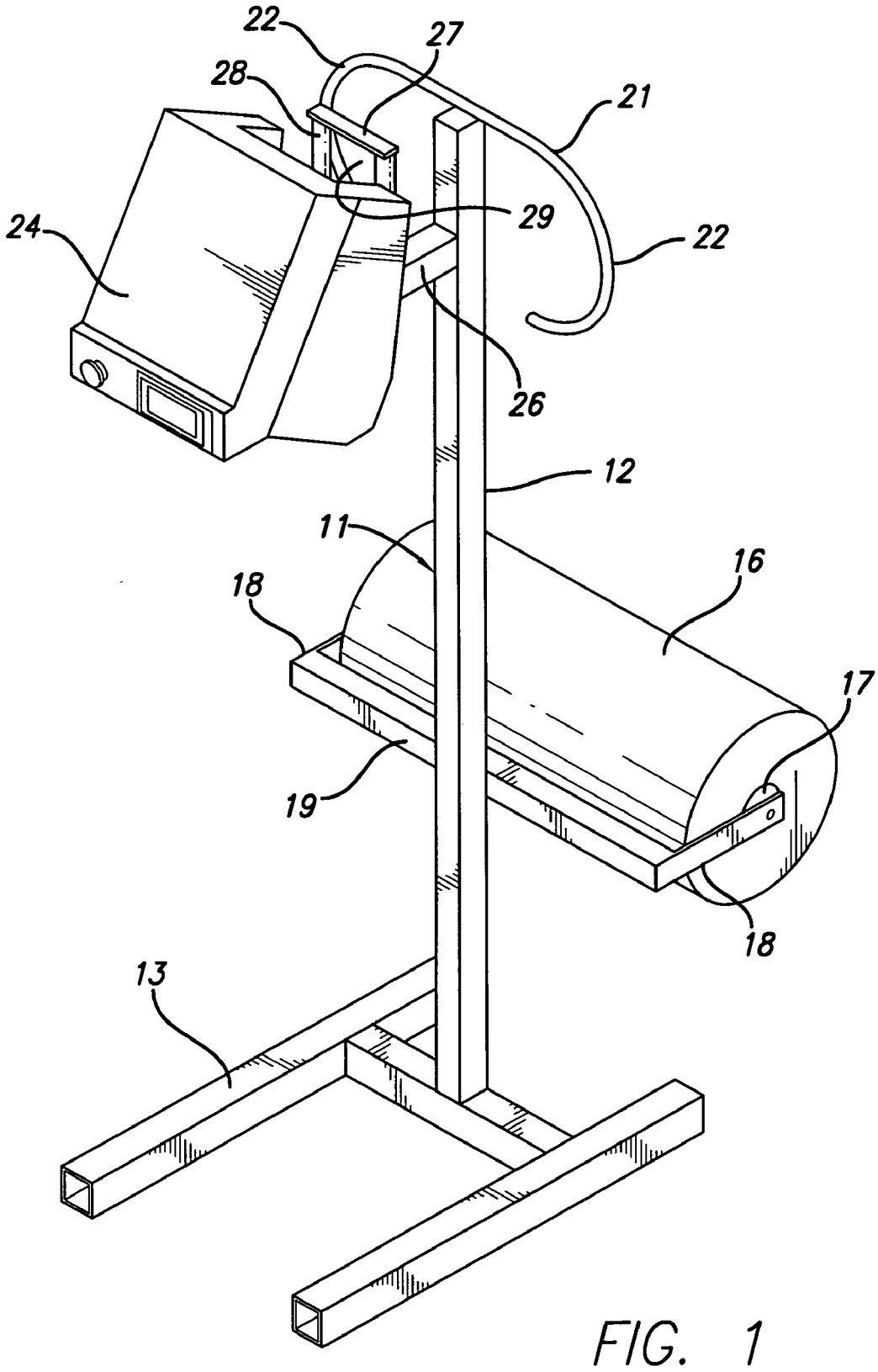
FIG. 1 is an isometric view of one embodiment of a machine for making paper dunnage in accordance with the invention.
Figure 2:
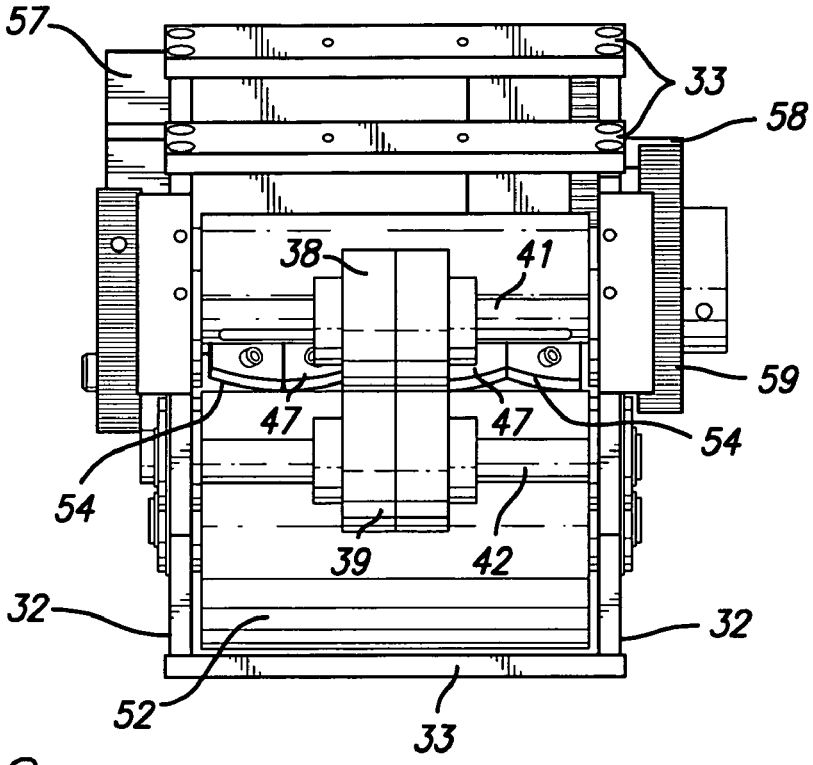
FIG. 2 is a top plan view of the crumpling mechanism in the embodiment of FIG. 1.
Figure 3:
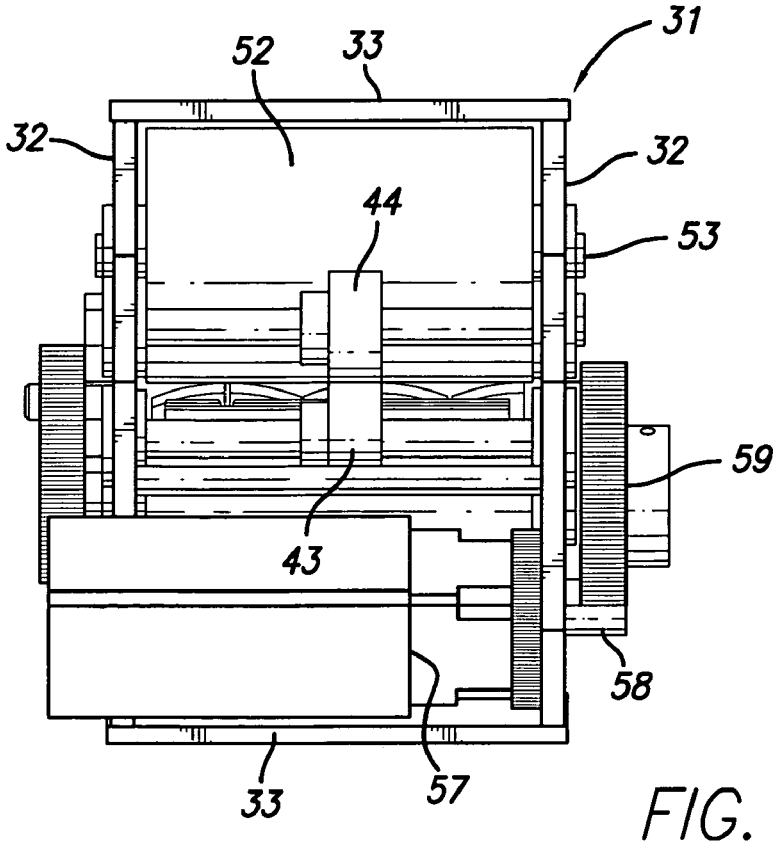
FIG. 3 is a bottom plan view of the crumpling mechanism in the embodiment of FIG. 1.
Figure 4:
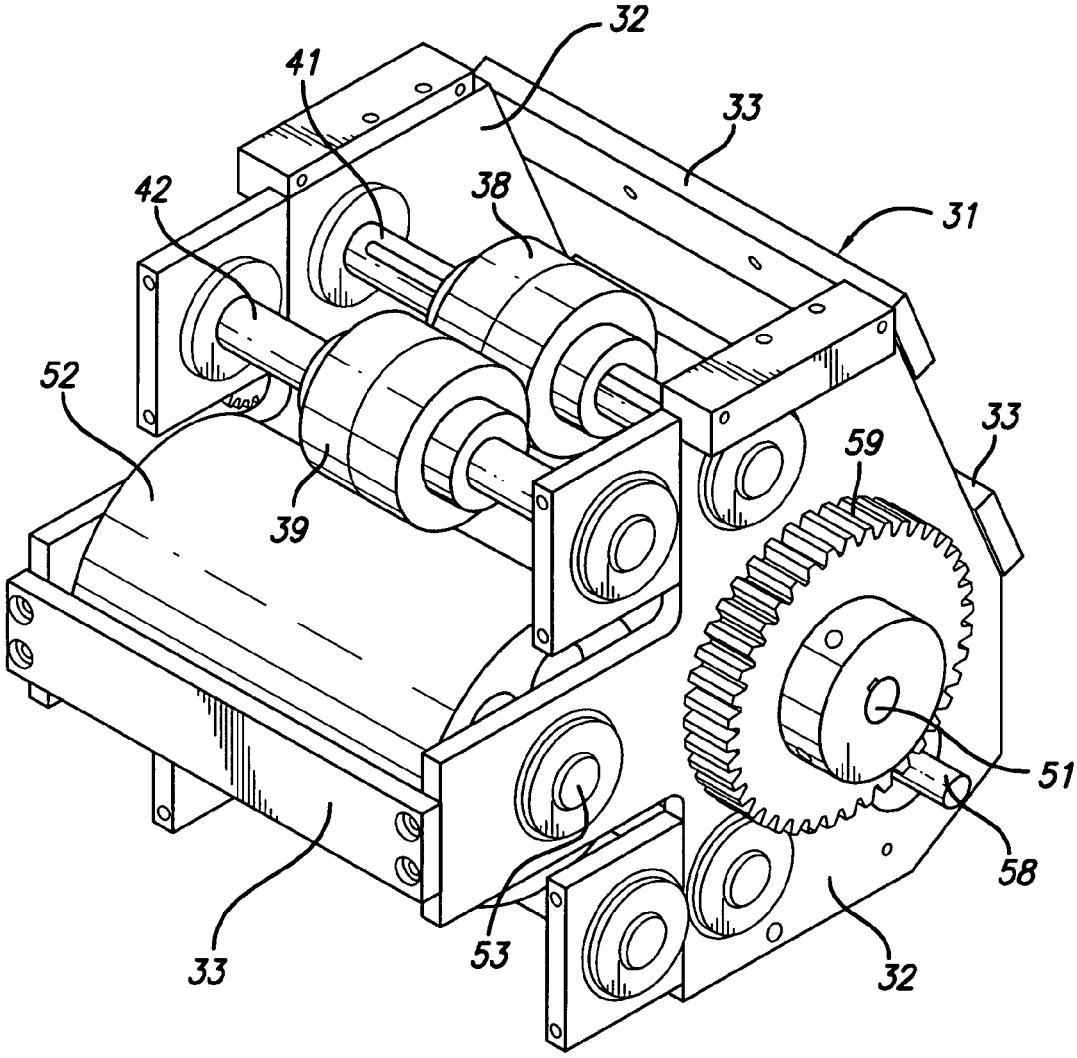
FIG. 4 is an isometric view of the crumpling mechanism in the embodiment of FIG. 1.

As illustrated in drawings, the dunnage making machine includes a stand 11 which has a post 12 which is held in an upright position by a base 13 which rests upon the floor or other supporting surface.

A roll of paper 16 to be formed into dunnage is rotatively mounted on a horizontally extending axle 17 on the rear side of the post. The axle is supported by a pair of arms 18, 18 which extend rearwardly from a cross member 19 affixed to the post.

The paper is preferably a single layer of material, such as 30–40 pound brown craft paper, although paper of other weights and/or types can be used, including paper stock having more than one layer of material. Alternatively, if desired, instead of a roll, the paper can be supplied in another form, e.g. fan-folded in a box.

Figure 6:
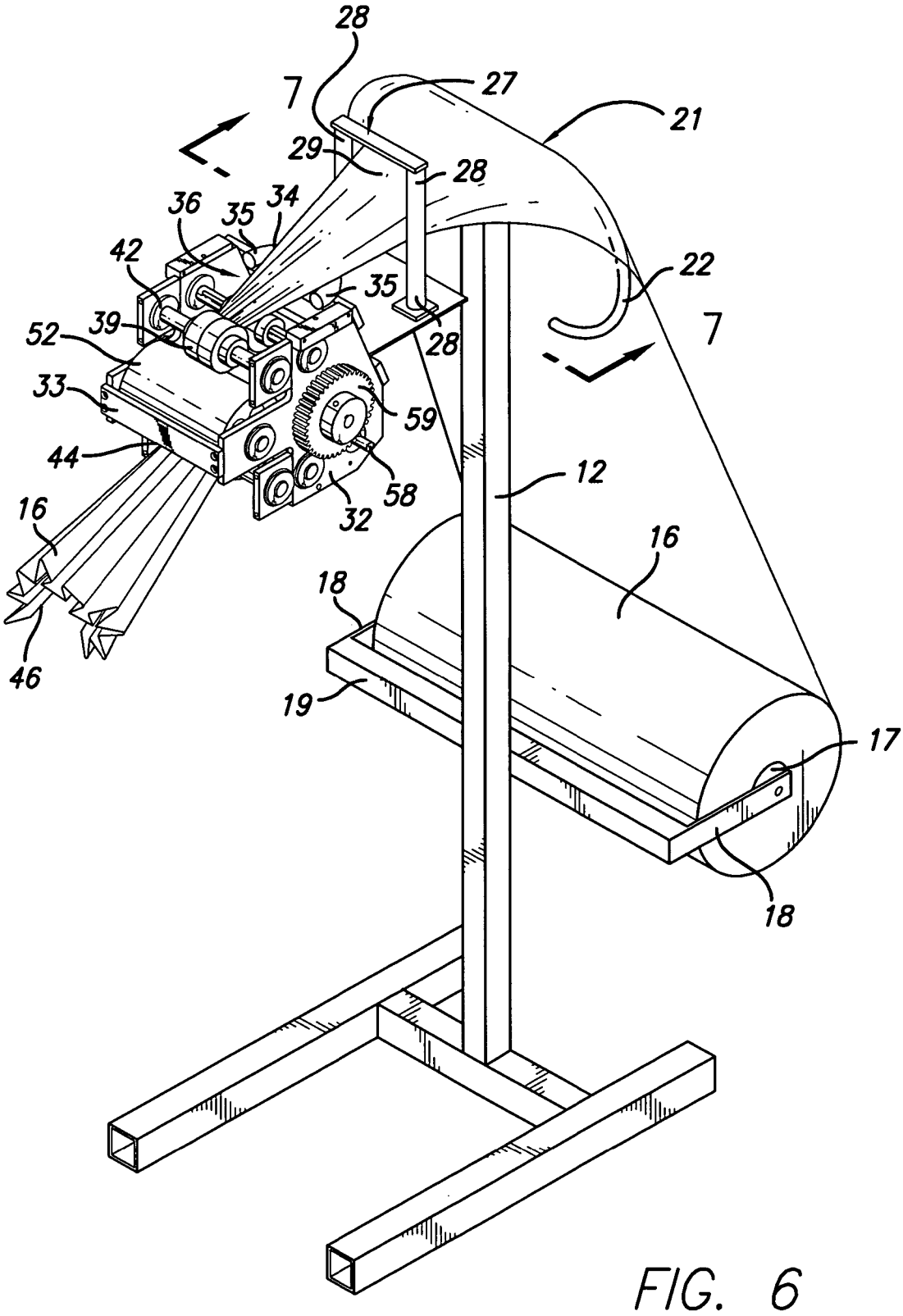
FIG. 6 is a fragmentary isometric view of the embodiment of FIG. 1, with the housing of the crumpling head removed and the machine in operation to convert paper stock into dunnage.

A forming bar 21 is affixed to the upper end of the post and has downwardly curved end sections 22, 22 separated by a distance less than the width of the paper for rolling the edge portions of the paper in a downward direction as the paper is drawn across the bar, as illustrated in FIG. 6.

A crumpling head 24 is mounted on a support arm 26 which extends in a forward direction from the post below the forming bar, and a throat section 27 is mounted on the arm between the post and the crumpling head.

The throat section has a pair of vertically extending side bars 28, 28 which define an opening 29 of lesser lateral extent than the distance between the end sections of the forming bar. As the paper is drawn through the throat opening from the forming bar, the rolled edge portions are drawn closer together and gathered or pleated, as shown in FIGS. 6 and 7.

The crumpling head has a frame 31 which includes a pair of side plates 32, 32, with cross members 33 extending between the side plates.

A U-shaped guide bar 34 is mounted on the upper side of the frame toward the rear of the crumpling head. This bar has a pair of side arms 35, 35 which extend in a direction generally perpendicular to the path of the paper and form a second throat section with an opening 36 of lesser lateral extent than the first. As the paper is drawn through this opening, the central portion of it is gathered or pleated, and the outer portions are gathered even further, as illustrated in FIG. 6. In the embodiment illustrated, the crumpling head is tilted back at an angle of about 45 degrees, and guide arms 35, 35 extend upwardly at a similar angle.

A pair of crumpling rollers 38, 39 are mounted on shafts 41, 42 which are journaled in the side plates in front of and below the U-shaped guide bar. The gathered or pleated paper is fed between these rollers, with the two rollers engaging opposite sides of the paper. The rollers serve the dual function of drawing the paper from the supply roll over the forming bar and through the two throat openings and then pressing the gathered or pleated paper together to complete the crumpling process.

Rollers 38, 39 are narrower in width than the throat openings and engage only the central portion of the paper. Consequently, only the central portion is tensioned, which facilitates the rolling of the edge portions about the curved end sections of the forming bar.

The forming head also has a pair of output rollers 43, 44 which are positioned below and generally in vertical alignment with the crumpling rollers. The output rollers are also relatively short in lateral extent, and they, too, engage only the central portion of the crumpled paper as they discharge it from the machine.

Figure 8:
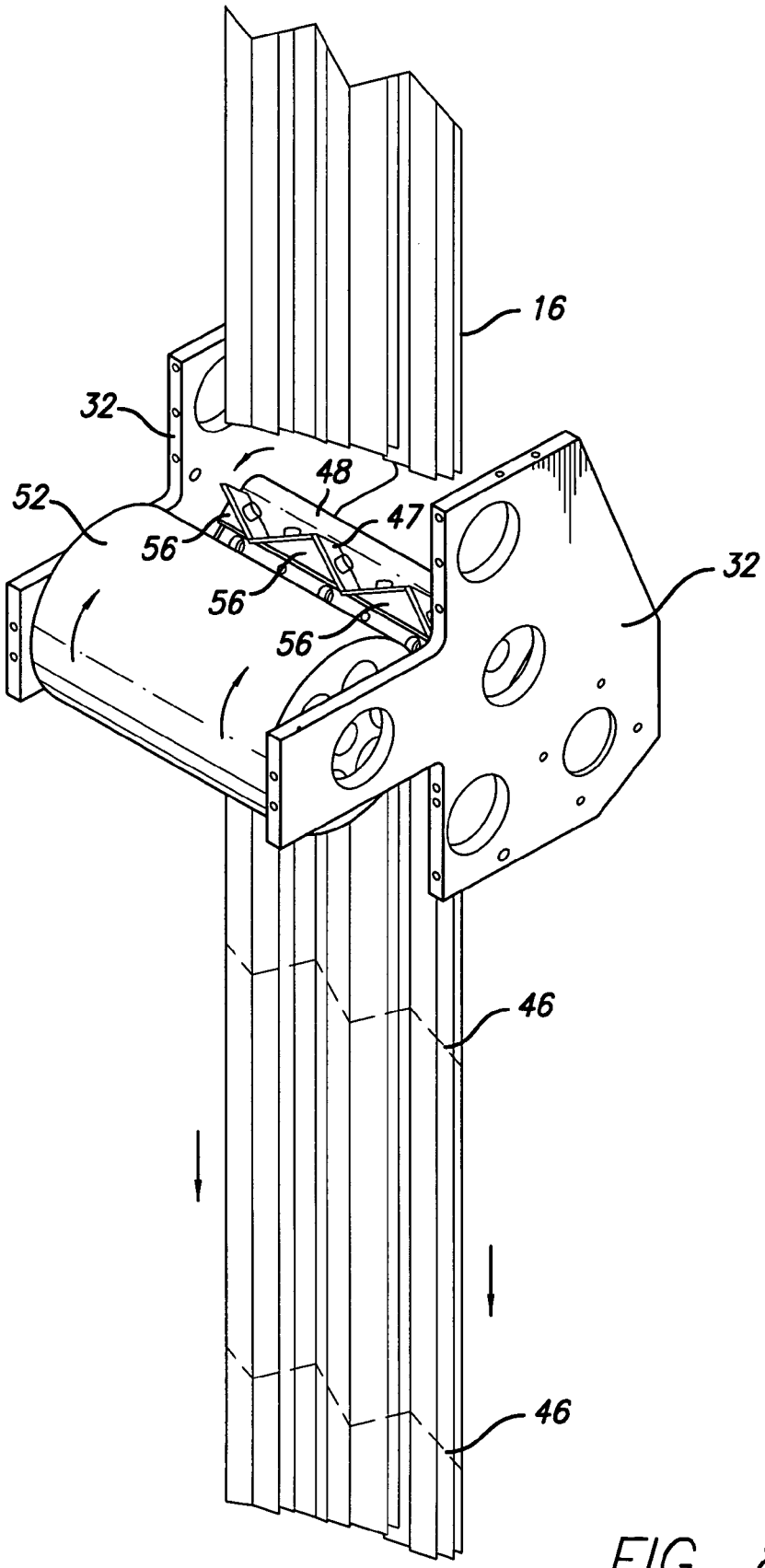
FIG. 8 is an operational view, similar to FIG. 5, illustrating the manner in which the dunnage material is perforated by the knives.
Figure 9:
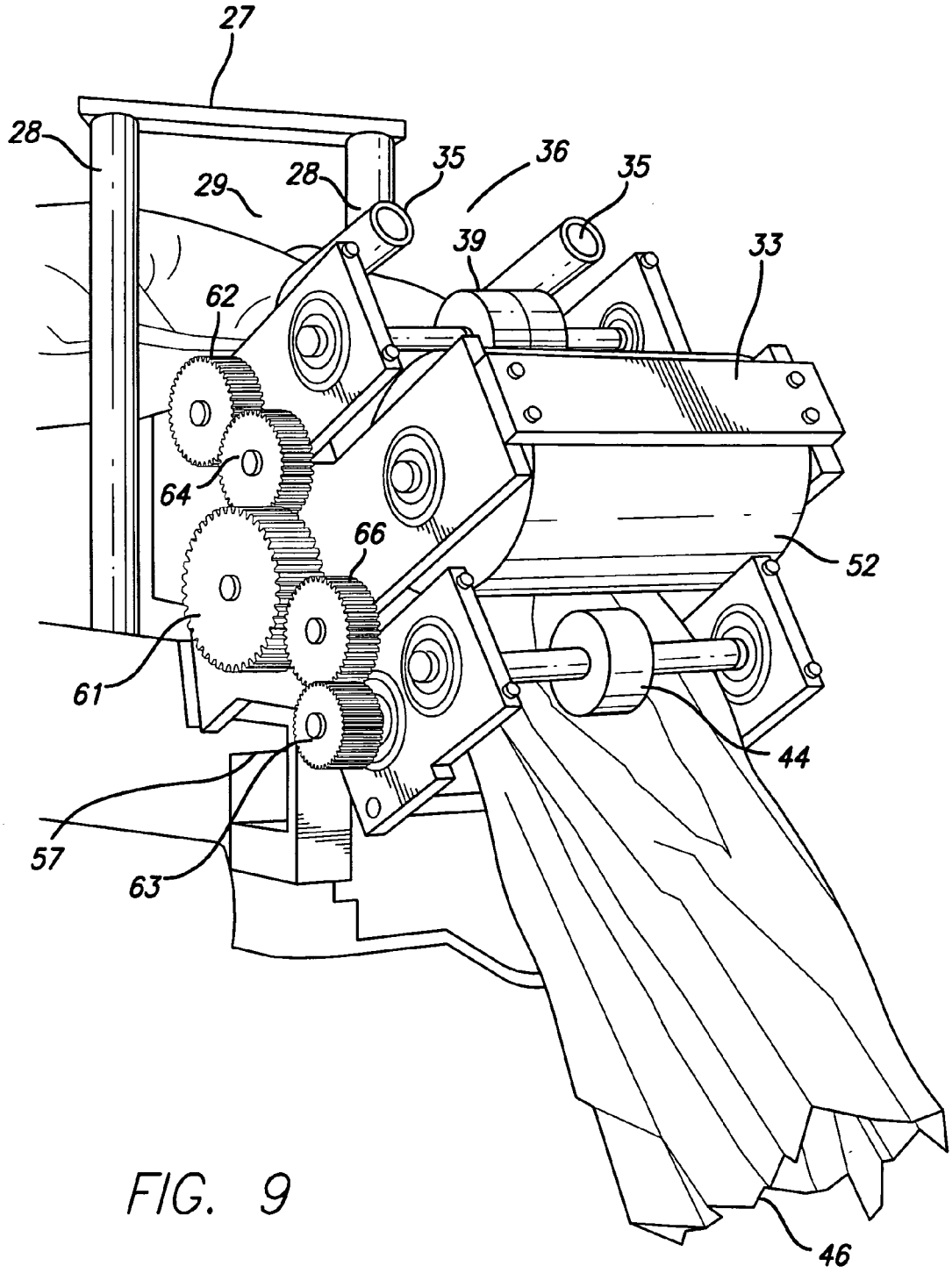
FIG. 9 is an isometric view of the crumpling head in the embodiment of FIG. 1, with the housing removed and the drive gears exposed.

To facilitate the tearing off of desired lengths of the crumpled paper dunnage material, it is perforated along laterally extending serrated lines 46 which are spaced at intervals along the length of the material, as best seen in FIG. 8. The perforations are formed by knife blades 47 in the forming head. These blades are arranged in a zig-zag pattern on the surface 48 of a mandrel 49 which is mounted on a shaft 51 between the crumpling rollers and the output rollers. The axis of the mandrel is perpendicular to the path of the paper, and when the mandrel rotates about its axis, the blades periodically come into contact with and perforate the crumpled paper at an interval determined by the circumference of the circle made by the tips of the blades.

A cylindrical support roller 52 is positioned on the side of the paper opposite the knives and mounted on a shaft 53 for rotation about an axis parallel to the axis of the mandrel. The support roller holds the paper against the knife blades, and it is fabricated of an ultra high molecular weight polyethylene which gives without being cut as the blades cut through the paper. The cutting edges 54 of the blades have an elliptical profile so that they remain in uniform and continuous contact with the support roller as they turn against it even though they are set at an angle to the axes of the mandrel and roller.

In the embodiment illustrated, mandrel 49 has a generally square cross section, and the blades are mounted on the side faces of blocks 56 on one of the flat surfaces of the mandrel. The side faces are set at angles relative to the longitudinal centerline of the surface, with alternate ones of the faces being set at equal but opposite angles to define a zig-zag pattern which is symmetrical about the centerline.

The rollers and knives are driven by a motor 57 which mounted between the side plates toward the rear of the crumpling head. In the embodiment illustrated, the motor is electrically driven, but any suitable type of motor can be utilized. A drive gear (not shown) on the output shaft 58 of the motor engages a gear 59 on mandrel shaft 51 on one side of the crumpling head.

Drive gears for the rollers are located on the other side of the head. They include an input gear 61 on the mandrel shaft which drives gears 62, 63 on the shafts of crumpling roller 38 and output roller 43 through idler gears 64, 66. In this particular embodiment, only the rear roller in each pair is driven, and the support roller 52 is not driven either. The undriven rollers are, of course, turned by the paper feeding past them.

Operation and use of the machine, and therein the method of the invention, are as follows. Paper is drawn manually from roll 16 over forming bar 21 and fed through throat openings 29, 36 to crumpling rollers 38, 39 which then engage the paper and feed it through the machine.

As the paper is drawn over forming bar 21, the edge portions of the paper are rolled down, as best seen in FIG. 6. As the paper is drawn through the first throat opening 29, the rolled edge portions are drawn closer together and gathered or pleated, as shown in FIGS. 6 and 7. When the paper passes through the second throat opening 36, the outer portions are gathered even further, and the central portion is also gathered or pleated, as illustrated in FIG. 6. As the paper passes between the crumpling rollers, pleated or gathered portions are pressed together to complete the crumpling process. Since the rollers engage only the central portion of the paper, only the central portion is tensioned, which makes it easier for the edge portions to roll down over the end sections of the forming bar.

The crumpled paper is fed between knife blades 47 and support roller where the serrated lines of perforations 46 are formed. Output rollers 43, 44 keep the paper taut as it feeds past the knives and discharge it in a downward and forward direction from the machine.

It is apparent from the foregoing that a new and improved dunnage making machine and method have been provided. While only certain presently preferred embodiments have been described in detail, as will be apparent to those familiar with the art, certain changes and modifications can be made without departing from the scope of the invention as defined by the following claims.

What is claimed is:

1. A dunnage making machine, comprising: an upstanding support post, means for rotatively supporting a roll of paper in a horizontal position on one side of the post, a forming bar at the upper end of the post with pair of downwardly curved end sections which are spaced apart by a distance less than the width of the paper for rolling down the edge portions of the paper as the paper is drawn over the bar, an arm extending from the side of the post opposite the paper, a crumpling head mounted on the arm, a throat section with a pair of vertically extending side bars mounted on the arm between the post and the crumpling head for receiving the paper from the forming bar and urging the edge portions of the paper toward each other and causing them to gather, a roller within the head for pressing the gathered paper to crumple it, and a knife within the head for perforating the crumpled paper along a serrated tear line.

2. The dunnage making machine of claim 1 including a second throat section positioned between the first named throat section and the crumpling roller for gathering the central portion of the paper and further gathering the edge portions.

3. The dunnage making machine of claim 1 wherein the knife comprises a plurality of blades mounted in zig-zag fashion on a mandrel which rotates about an axis with the blades in periodic engagement with the surface of a support roller.

4. The dunnage making machine of claim 3 wherein the knife blades have cutting edges with an elliptical profile.

5. The dunnage making machine of claim 3 wherein the support roller is fabricated of ultra high molecular weight polyethylene.

6. A machine for crumpling paper to make dunnage, comprising: a forming bar having a pair of curved end sections which are spaced apart by a distance less than the width of the paper so that the edge portions of the paper tend to be rolled toward each other as the paper is drawn across the forming bar, a first throat section having an opening of substantially lesser dimension than the spacing between the end sections of the forming bar for further rolling the edge portions toward each other and gathering them for crumpling, a second throat section having an opening of lesser dimension than the first throat opening for gathering the central portion of the paper and further gathering the edge portions, and a pair of rollers engagable with opposite sides of the paper for drawing the paper over the forming bar and through the throat openings, then pressing the gathered portions together.

7. The machine of claim 6 wherein the rollers are of lesser width than the throat openings and tension only the central portion of the paper as the paper is drawn across the forming bar and through the openings.

8. The machine of claim 6 including knives for perforating the crumpled paper along a serrated line.

9. A machine for making paper dunnage, comprising:

means for feeding paper along a path, means for drawing edge portions of the paper together and gathering the paper as it is fed along the path, a crumpling roller engagable with the gathered paper, a cylindrical mandrel oriented with its axis generally perpendicular to the path of the paper and having at least one flat side which is tangential to the axis, a plurality of blades mounted on the flat surface in zig-zag fashion along a line parallel to the axis for periodic engagement with the paper as the mandrel rotates about its axis, and a support roller rotatable about an axis parallel to the axis of the mandrel with a surface which supports the paper for engagement by the blades.

10. The machine of claim 9 wherein the support roller is fabricated of ultra high molecular weight polyethylene.

11. The machine of claim 9 wherein the knife blades have cutting edges with an elliptical profile.

12. A machine for crumpling paper to make dunnage, comprising: a forming element having a pair of curved end sections which are spaced apart by a distance less than the width of the paper so that the edge portions of the paper tend to be rolled toward each other as the paper is drawn across the forming element, a first throat section having an opening of substantially lesser dimension than the spacing between the end sections of the forming element for further rolling the edge portions toward each other and gathering them for crumpling, a second throat section having an opening of lesser dimension than the first throat opening for gathering the central portion of the paper and further gathering the edge portions, and a roller for drawing the paper over the forming element and through the throat openings, then pressing the gathered portions together, with the roller being of lesser width than the throat openings so as to tension only the central portion of the paper as the paper is drawn across the forming element and through the openings.

13. The machine of claim 12 including knives for perforating the crumpled paper along a serrated line.

* * * * *